United States Patent [19]

Banziger et al.

[11] 4,396,469

[45] Aug. 2, 1983

[54] PROCESS AND APPARATUS FOR CONTINUOUSLY COATING A SOLID ELECTROLYTE WITH A CATALYTICALLY ACTIVE METAL

[75] Inventors: Robert Banziger, Fislisbach; Hans-Jorg Christen, Untersiggenthal; Samuel Stucki, Baden, all of Switzerland

[73] Assignee: BBC Brown, Boveri & Company, Limited, Baden, Switzerland

[21] Appl. No.: 302,986

[22] Filed: Sep. 17, 1981

[30] Foreign Application Priority Data

Sep. 19, 1980 [CH] Switzerland ..... 7049/80

[51] Int. Cl.[3] ..... C25D 5/04; C25D 17/00

[52] U.S. Cl. ..... 204/24; 204/224 R

[58] Field of Search ..... 204/24, 224 R

[56] References Cited

U.S. PATENT DOCUMENTS

| | | | |
|---|---|---|---|
| 936,472 | 10/1909 | Pfanhauser | 204/206 |
| 2,540,602 | 2/1951 | Thomas | 204/224 R |
| 3,806,441 | 4/1974 | Rowe | 204/224 R |
| 4,326,930 | 4/1982 | Nagel | 204/24 |

*Primary Examiner*—T. M. Tufariello

*Attorney, Agent, or Firm*—Oblon, Fisher, Spivak, McClelland & Maier

[57] ABSTRACT

A process and apparatus for continuously coating a solid electrolyte with a catalytically active metal, whereby large-area sheets of the solid electrolyte are continuously coated in a uniform manner with the catalytically active metals, by first being impregnated with an aqueous solution of the particular metal and subsequently being passed through, in a water bath, between two rolls acting as electrodes, wherein a felt of carbon is arranged on the cathode side interposed between the electrolyte and the cathode roll, and thus being subjected to an electrolysis process.

9 Claims, 3 Drawing Figures

PROCESS AND APPARATUS FOR CONTINUOUSLY COATING A SOLID ELECTROLYTE WITH A CATALYTICALLY ACTIVE METAL

BACKGROUND OF THE INVENTION

1. Field of the Invention

This invention relates to a process for continuously coating a solid electrolyte with a catalytically active metal, as well as an apparatus for implementing the method.

2. Description of the Prior Art

In aqueous electrolysis, in particular in the production of hydrogen by decomposition of water, solid electrolytes based on organic synthetic materials are increasingly used. It proves necessary to coat solid electrolytes of this type, which as a rule are in the form of sheets, with a suitable electro-catalyst which in most cases is a platinum metal. A coating process of this type, which is based on electrolytic deposition of the metal in question, and a corresponding apparatus are known from German Offenlegungsschrift No. 2,821,271. According to the latter, the plastic sheet which is to be coated is first impregnated with an aqueous metal salt solution and then inserted into a sandwich electrolytic cell and subjected to an electrolysis, the metal being deposited on the cathode side.

The process and apparatus of the type described are quite satisfactory for laboratory purposes and usually have relatively small dimensions. Difficulties arise in the coating of large-area sheets and of large quantities, above all with respect to maintaining the bath temperature and the uniformity of the electrolysis process. In addition, such a method would not be very economical. There is therefore a requirement for improving the process and for suggesting a more suitable apparatus.

SUMMARY OF THE INVENTION

Accordingly, one object of this invention is to provide a novel process and apparatus for continuously coating a solid electrolyte with a catalytically active metal, whereby a perfect and uniform deposition even on large-area sheets is ensured in a simple and economical manner.

A further object, in particular, is to make industrial large-scale production possible.

These and other objects are achieved by providing a new and improved process and apparatus for continuously coating a solid electrolyte with a catalytically active metal wherein the solid electrolyte in the form of a sheet is dried, is treated in a solution which contains the metal as a salt, then is rinsed in distilled water and finally is subjected to an electrolysis step in a cell which is fed with distilled water of constant temperature and to which a constant current density is applied. The solid electrolyte is passed through, in a water bath between two rolls formed as electrodes, wherein a felt of carbon is interposed on the cathode side.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
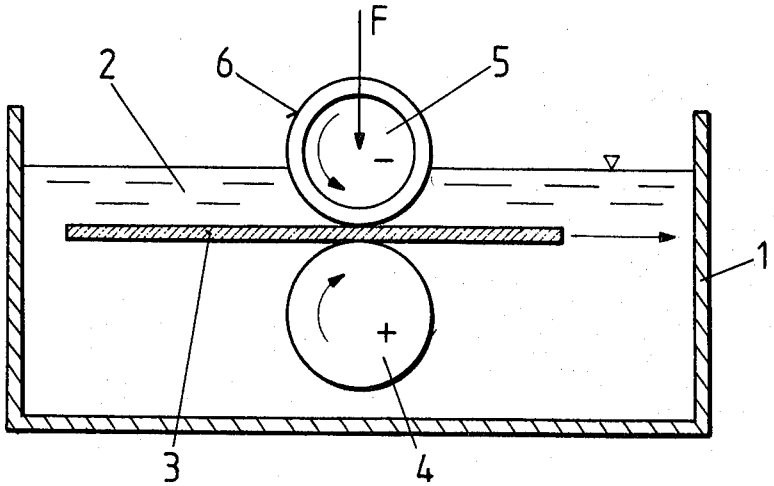
FIG. 1 is a diagrammatic cross-sectional view through one embodiment of the apparatus of the invention.

Referring now to the drawings, wherein like reference numerals designate identical or corresponding parts throughout the several views, and more particularly to FIG. 1 thereof, a first type of equipment suitable for carrying out the process is shown diagrammatically. In a rectangular trough 1 which can consist, for example, of polypropylene, there is a water bath 2 (distilled or demineralized water). Within the trough 1 are provided two rolls 4 and 5 which advantageously are arranged with horizontal axes and serve as the electrodes. The lower roll 4 which serves as the anode and preferably consists of platinized titanium is completely submerged in the water bath 2, whilst the upper roll 5 which acts as the cathode and advantageously consists of corrosion-resistant steel is immersed in the water only in the electrolysis zone. The solid electrolyte 3 which is to be coated and is in the form of a sheet is located between the two rolls 4 and 5, a felt 6 of carbon being interposed between the two rolls 4 and 5. The felt 6 is arranged on the cathode side and, in the present example, coaxially envelops the roll 5. It is rigidly bonded to the latter, for example by means of a synthetic adhesive (epoxy resin). The contact force is indicated by a vertical arrow F.

Figure 2:
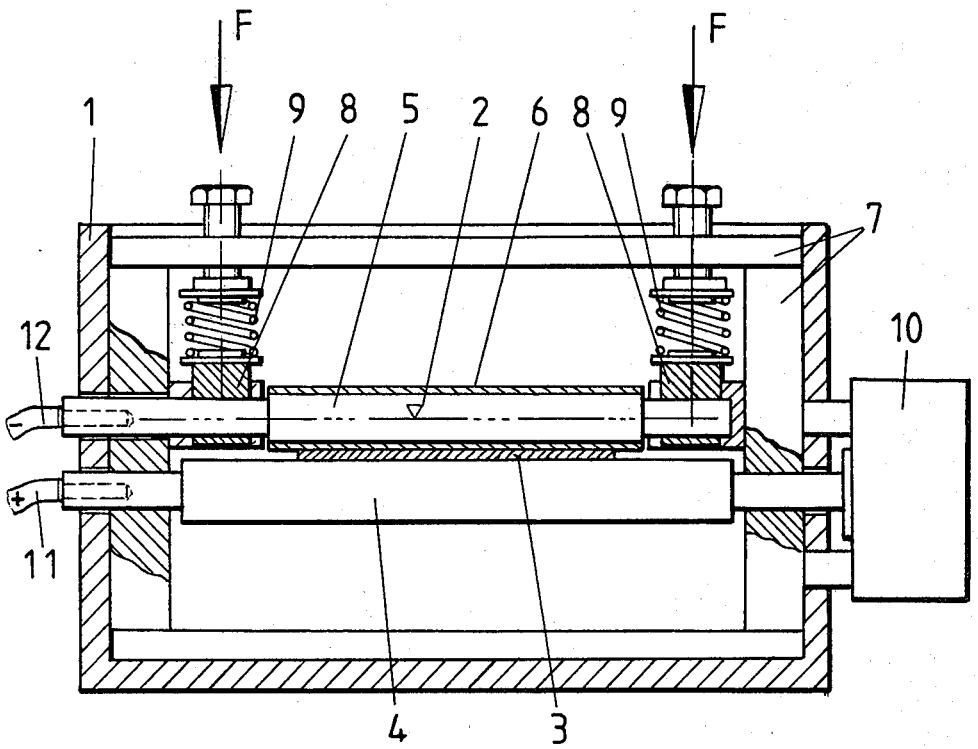
FIG. 2 is a semi-diagrammatic longitudinal cross-sectional view through one embodiment of the equipment.

FIG. 2 represents a semi-diagrammatic longitudinal cross-sectional view through an embodiment of the apparatus of the invention. In a rectangular trough 1 of polypropylene, a frame 7 of the roll support is fitted, wherein a lower roll 4, which serves as the anode, of platinized titanium in a stationary mounting is driven by a drive motor 10. An upper roll 5 of stainless steel, which serves as the cathode, and has a felt 6 of carbon as a sheathing, which is firmly bonded thereto by means of synthetic resin, is mounted for vertical displacement in insulated bearings 8 which are in turn supported via springs 9 on the frame 7. The contact pressure of the roll 5 can be adapted in an optimum manner to the particular conditions by selecting the spring pre-tension which can be adjusted via the fixing screws. The spring force is indicated by vertically downward-pointing arrows F. The rolls 4, 5 are provided with current leads 11, 12. Reference numeral 3 represents the cross-section of the solid electrolyte, which is to be coated, in the form of a sheet. The level of the water bath 2 (distilled or demineralized water) is not important. The water can partially or wholly cover the upper roll. The drawing of the apparatus is not true to scale. In particular, the roll width can be many times that in the illustration and depends on the width of the sheet which is to be coated.

Figure 3:
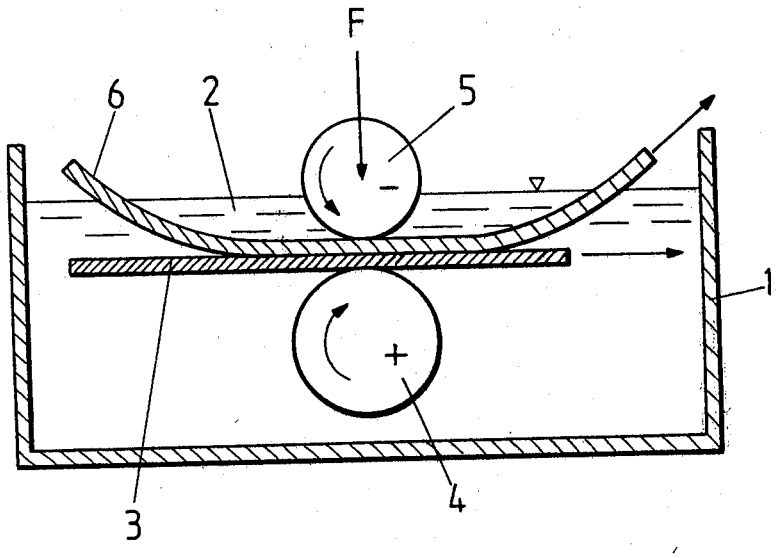
FIG. 3 is a diagrammatic cross-sectional view through another embodiment of the equipment.

FIG. 3 shows a diagrammatic cross-sectional view through another embodiment of the apparatus of the invention. The trough 1, the water bath 2, the solid electrolyte 3 in the form of a sheet and the lower roll 4 serving as the anode (positive pole) largely correspond to the arrangement according to FIG. 1. The upper roll 5 acting as the cathode, however, does not carry a sheathing, but the felt 6 of carbon is merely inserted loosely on the cathode side between the solid electrolyte 3 and the roll 5 and, in the zone of the rolls, is passed through plane-parallel with the solid electrolyte 3. This arrangement enables the felt 6 to be rapidly exchanged, if required by circumstances (different dimensions, for example thickness, physiochemical nature, wear, and the like).

The invention is not restricted to the embodiments shown in the figures. The principle of the rolls can also be put into practice by different arrangements. For example, the rolls can also be arranged with their axes in a vertical position or inclined position (at an angle to the horizontal).

PROCESS EXAMPLE

See FIG. 1 and FIG. 2.

A dried sheet of solid electrolyte 3 (base: perfluorinated sulphonic acid: trade name "Nafion" from DuPont de Nemours) having a square area of 250 mm side length and a thickness of 0.2 mm was impregnated for 30 minutes in a solution of 0.5% by weight of $Pt(NH_3)_2(NO_2)_2$ (diamminoplatinum dinitrite) in distilled water at 90° C. After the impregnation, the sheet was removed from the solution and rinsed with distilled water. The sheet was then subjected in the apparatus according to FIG. 2 to an electrolysis process by passing it through between the rolls 4 and 5. The deposition of the metallic platinum layer on the cathode side was carried out under the following conditions:

Total contact force 2F of the springs: 220 N
Current intensity: 30 A
Speed of rotation of the lower roll: 0.17/minute
Corresponding speed of advance of the sheet: 1.6 cm/minute
Temperature of the water bath: 25° C.

After the end of the disposition process, the solid electrolyte sheet was boiled up in 1 N hydrochloric acid in order to remove the unconverted platinum complex salt. The coating thickness of the deposited platinum layer was about 0.5 mg/cm$^2$.

Of course, the process is not restricted to the above example. In principle, any catalytically active metals can be continuously deposited from suitable salt solutions onto the surface of a solid electrolyte in this manner. As a variation, the process which can be realized with the equipment according to FIG. 3 can here also be used.

The process according to the invention and the apparatus according to the invention enable solid electrolytes to be continuously coated over a large area with catalytically active metals, in particular noble metals, firmly adhering surface layers of high uniformity being obtained.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for continuously coating a solid electrolyte with a catalytically active metal, wherein a solid electrolyte in the form of a sheet having opposite sides is dried, treated in a solution which contains the metal as a salt, then rinsed in distilled water and finally subjected to an electrolysis step in a cell which is fed with distilled water of constant temperature and to which a constant current density is applied, comprising:

providing a pair of opposed cathode and anode rolls respectively serving as cathode and anode electrodes;

interposing a felt of cabon between said cathode and anode rolls; and passing the solid electrolyte through, in a water bath, between said cathode and anode rolls with the felt of carbon interposed between said cathode roll and said electrolyte and the opposite sides of said electrolyte contacting the felt of carbon and the anode roll, respectively.

2. A process according to claim 1, comprising:

forming the felt of carbon as a coaxial unit with the roll formed as the cathode; and rotating the felt synchronously with the cathode.

3. A process according to claim 1, comprising:

maintaining the felt of carbon in a loose state; and passing the felt in an electrolysis zone of the rolls between the rolls plane-parallel with the solid electrolyte, said solid electrolyte disposed on the cathode side between the rolls.

4. An apparatus for continuously coating a solid electrolyte having opposite sides with a catalytically active metal, comprising:

a trough containing a water bath consisting of distilled water;

a first roll serving as an anode;

a second roll disposed opposite said anode roll and serving as a cathode; and a felt of carbon arranged on the cathode side, said felt being maintained between said solid electrolyte and said cathode roll with said electrolyte disposed with the opposite sides of said electrolyte in contact with said felt of carbon and said anode roll.

5. An apparatus according to claim 4, comprising:

the felt of carbon coaxially enclosing the roll and rigidly bonded to the latter by means of a synthetic resin.

6. An apparatus according to claim 4, wherein the felt of carbon is in a loose state and, in an electrolysis zone between the rolls, assumes a position which is plane-parallel to the solid electrolyte.

7. An apparatus according to claim 4, comprising:

the roll serving as the anode arranged beneath the roll serving as the cathode and completely submerged in the water bath; and the roll serving as the cathode arranged above said anode roll and partially or completely immersed in the water bath.

8. An apparatus according to claim 4, wherein the anode roll consists of platinized titanium and the cathode roll consists of corrosion-resistant steel.

9. An apparatus according to claim 4, comprising:

the trough consisting of polypropylene and having rectangular shape defining an interior;

a rectangular frame serving as a roll support located in the interior of said trough;

said anode roll mounted on a stationary mounting;

a drive motor for driving said cathode;

said cathode roll being vertically movable and arranged in the rectangular frame by means of insulated bearing and adjustable springs; and current leads coupled to said rolls for making electrical connection to respective of said rolls.

* * * * *